US008567921B2

(12) United States Patent
Yoshida et al.

(10) Patent No.: US 8,567,921 B2
(45) Date of Patent: Oct. 29, 2013

(54) INK-JET APPARATUS

(75) Inventors: Hidehiro Yoshida, Osaka (JP); Kazuki Fukada, Osaka (JP); Keisei Yamamuro, Osaka (JP)

(73) Assignee: Panasonic Corporation, Osaka (JP)

( * ) Notice: Subject to any disclaimer, the term of this patent is extended or adjusted under 35 U.S.C. 154(b) by 32 days.

(21) Appl. No.: 13/072,895

(22) Filed: Mar. 28, 2011

(65) Prior Publication Data

US 2011/0234706 A1 Sep. 29, 2011

(30) Foreign Application Priority Data

Mar. 29, 2010 (JP) ..... 2010-074663
Jan. 25, 2011 (JP) ..... 2011-012597

(51) Int. Cl.
*B41J 2/045* (2006.01)
*B41J 2/175* (2006.01)
*B41J 2/18* (2006.01)

(52) U.S. Cl.
USPC ..... 347/68; 347/85; 347/89

(58) Field of Classification Search
USPC ..... 347/68, 70–72
See application file for complete search history.

(56) References Cited

U.S. PATENT DOCUMENTS

| | | | | |
|---|---|---|---|---|
| 6,450,627 | B1 | 9/2002 | Moynihan et al. | |
| 6,561,608 | B1 * | 5/2003 | Yamamoto et al. | 347/15 |
| 7,111,927 | B2 | 9/2006 | Kitahara | |
| 7,157,837 | B2 | 1/2007 | Kojima | |
| 2003/0210304 | A1 * | 11/2003 | Takahashi | 347/68 |
| 2004/0080578 | A1 * | 4/2004 | Dunfield et al. | 347/54 |
| 2006/0227179 | A1 | 10/2006 | Temple et al. | |

FOREIGN PATENT DOCUMENTS

| | | |
|---|---|---|
| JP | 60-217160 | 10/1985 |
| JP | 2001-121693 | 5/2001 |
| JP | 2001-347660 | 12/2001 |
| JP | 2004-259865 | 9/2004 |
| JP | 2006-510506 | 3/2006 |
| JP | 2006-088575 | 6/2006 |
| JP | 2007-175921 | 7/2007 |
| JP | 2008-254196 | 10/2008 |
| WO | 2004/056572 | 7/2004 |

* cited by examiner

*Primary Examiner* — Lisa M Solomon
(74) *Attorney, Agent, or Firm* — Panasonic Patent Center

(57) ABSTRACT

An ink-jet apparatus includes an ink supply flow path, an ink discharge flow path, and an ink flow path connecting them, in which piezoelectric elements are provided in the ink flow path having at least one turn part, the piezoelectric elements are arranged to be opposed to the ink flow path and are provided upstream of the turn part in the ink flow path and downstream of the turn part in the ink flow path, and a nozzle is provided between the piezoelectric element and the turn part in the ink flow path.

11 Claims, 8 Drawing Sheets

INK-JET APPARATUS

BACKGROUND

1. Technical Field

The present technical field relates to an ink-jet apparatus.

2. Description of the Related Art

An ink-jet apparatus has a head capable of applying a required amount of ink to an object at given timing in response to an input signal. Especially, a piezoelectric ink-jet apparatus has been positively developed because various kinds of ink can be applied while being controlled with high precision.

In general, the piezoelectric ink-jet apparatus includes an ink supply flow path, an ink flow path connected to the ink supply flow path and having a nozzle, and a piezoelectric element to apply a pressure to ink supplied into the ink flow path. Thus, mechanical strain is generated in the piezoelectric element by applying a drive voltage to the piezoelectric element, and the ink is ejected from the nozzle by applying a pressure to the ink in the ink flow path. In addition, a space in which the ink is collected is called an ink chamber or a pressure chamber provided in the ink flow path.

For example, a configuration of a representative ink-jet apparatus is provided such that the piezoelectric element is arranged on a wall surface of the pressure chamber provided upstream of an ejection hole, and the wall surface of the pressure chamber is pressed by driving the piezoelectric element and a pressure is applied to the ink filled in the pressure chamber, whereby the ink is ejected from the ejection hole (refer to FIG. 1 of Unexamined Japanese Patent Publication No. 2001-121693. In addition, FIG. 1 of Unexamined Japanese Patent Publication No. 60-217160 discloses an ink-jet head provided such that electrostrictive element 4 is arranged in a part of ink supply path 11, and ink is ejected from nozzle 9. In addition, ink-jet apparatuses are disclosed in Unexamined Japanese Patent Publication No. 2007-175921, Japanese Translation of PCT Publication No. 2006-510506, Unexamined Japanese Patent Publication No. 2004-259865, Unexamined Japanese Patent Publication No. 2001-347660, U.S. Patent Publication No. 2006/0227179, U.S. Pat. No. 6,450,627, U.S. Pat. No. 7,157,837, and U.S. Pat. No. 7,111,927.

However, an idea of circulating ink in the ink-jet apparatus is not disclosed in the above Unexamined Japanese Patent Publication No. 2001-121693 and Unexamined Japanese Patent Publication No. 60-217160 at all. That is, the ink-jet apparatuses disclosed in Unexamined Japanese Patent Publication No. 2001-121693 and Unexamined Japanese Patent Publication No. 60-217160 are simply based on a technique to eject liquid held in the pressure chamber (ink supply path) from a nozzle hole by driving the piezoelectric element, and they are not based on a technique to provide an ink supply flow path and an ink discharge flow path and circulate ink therebetween.

Especially, in the configuration of the ink-jet apparatus in Unexamined Japanese Patent Publication No. 2001-121693, the ink could stagnate in a corner part of the pressure chamber or the nozzle hole, and the nozzle hole could be clogged. Thus, in a case where the ink has high viscosity, it is hard to eject the ink from the nozzle hole. In addition, as for the ink-jet head in Unexamined Japanese Patent Publication No. 60-217160, a pressure generated by driving electrostrictive element 4 and applied to the ink flowing in ink supply path 11 is dispersed to the upstream side of electrostrictive element 4 (in a direction opposite to nozzle 9), so that it is difficult to eject the ink strongly toward nozzle 9.

SUMMARY

The present invention was made in view of the above circumstances, and it is an object of embodiments of the present invention to provide an ink-jet apparatus capable of implementing combination of (1) strong ink ejection to surely eject high-viscosity ink, and (2) circulation of the ink to prevent the ink from being dried in the vicinity of a nozzle, and (3) miniaturization of the apparatus as a whole.

An ink-jet apparatus according to embodiments of the present invention has the following characteristics.

According to a first aspect, an ink-jet apparatus includes an ink supply flow path supplied with ink from an ink inlet, an ink discharge flow path configured to discharge the ink to an ink outlet, and an ink flow path configured to connect the ink supply flow path to the ink discharge flow path, having at least one turn, and having a nozzle configured to eject the ink, in which piezoelectric elements are provided in the ink flow path, and the piezoelectric elements are arranged to be opposed to the ink flow path and are provided upstream of the turn part in the ink flow path and downstream of the turn part in the ink flow path.

Thus, the ink-jet apparatus according to embodiments of the present invention can surely eject the ink even when the ink has high viscosity, and can surely prevent the ink from being dried in the vicinity of the nozzle. Furthermore, the ink-jet apparatus according to the present invention can be miniaturized as a whole.

According to a second aspect, it is preferable that the nozzle is provided between the piezoelectric element and the turn part in the ink flow path.

According to a third aspect, it is preferable that an end part of the piezoelectric element is arranged to be opposed to the turn part in the ink flow path. In this configuration, since the ink flowing in the ink flow path can be collected in the narrow space as much as possible, and the force provided by driving the piezoelectric element is applied to the ink in this state, the ink can be ejected from the nozzle with stronger force.

According to a fourth aspect, it is preferable that a width of electrodes of the piezoelectric element arranged upstream of the turn part is larger than a width of electrodes of the piezoelectric element arranged downstream of the turn part. This is because the ink to be ejected from the nozzle can be effectively collected in the ink flow path.

According to a fifth aspect, it is preferable that a vibration plate is arranged between the piezoelectric element and the ink flow path.

According to a sixth aspect, a flow path cross-sectional area becomes smaller at a part provided in the ink flow path from the nozzle toward the ink discharge flow path, so that the force to eject the ink from the nozzle can be more enhanced.

According to a seventh aspect, it is preferable that a flow path cross-sectional area becomes larger at a part provided in the ink flow path from the ink supply flow path toward the turn part.

According to an eighth aspect, it is preferable that a flow path cross-sectional area gradually becomes smaller in the ink flow path from the ink supply flow path toward the turn part.

Since the ink-jet apparatus according to the embodiments of the present invention is configured such that the piezoelectric elements are arranged to be opposed to the flow path provided upstream of the turn part formed in the ink flow path, and the flow path provided downstream of the turn part, the ink can be effectively collected in the ink flow path. Since the ink is pressed in this state, the ink-jet apparatus according to the present invention can apply strong ejection force to the ink to be ejected from the nozzle, so that even high-viscosity ink can be surely ejected. In addition, since the ink-jet apparatus according to the present invention is configured such that the ink flow path is arranged to connect the ink supply flow path and the ink discharge flow path, the ink can be circulated and as a result, the ink around the nozzle can be prevented from being dried. As a result, reliability of the ink-jet apparatus can be improved.

In addition, the piezoelectric elements of the ink-jet apparatus according to the embodiments of the present invention are arranged to be opposed to the ink flow paths provided upstream and downstream of the nozzle. Thus, the piezoelectric element according to the embodiments of the present invention has a function to move the ink provided upstream of the nozzle toward the nozzle in the ink flow path, and a function to apply fluid resistance to the ink provided downstream of the nozzle, so that the ink-jet apparatus can be miniaturized as compared with a configuration in which a piezoelectric element is arranged in each of parts provided upstream and downstream of a nozzle.

DETAILED DESCRIPTION OF THE PREFERRED EMBODIMENTS

Ink-Jet Apparatus

Figure 1:
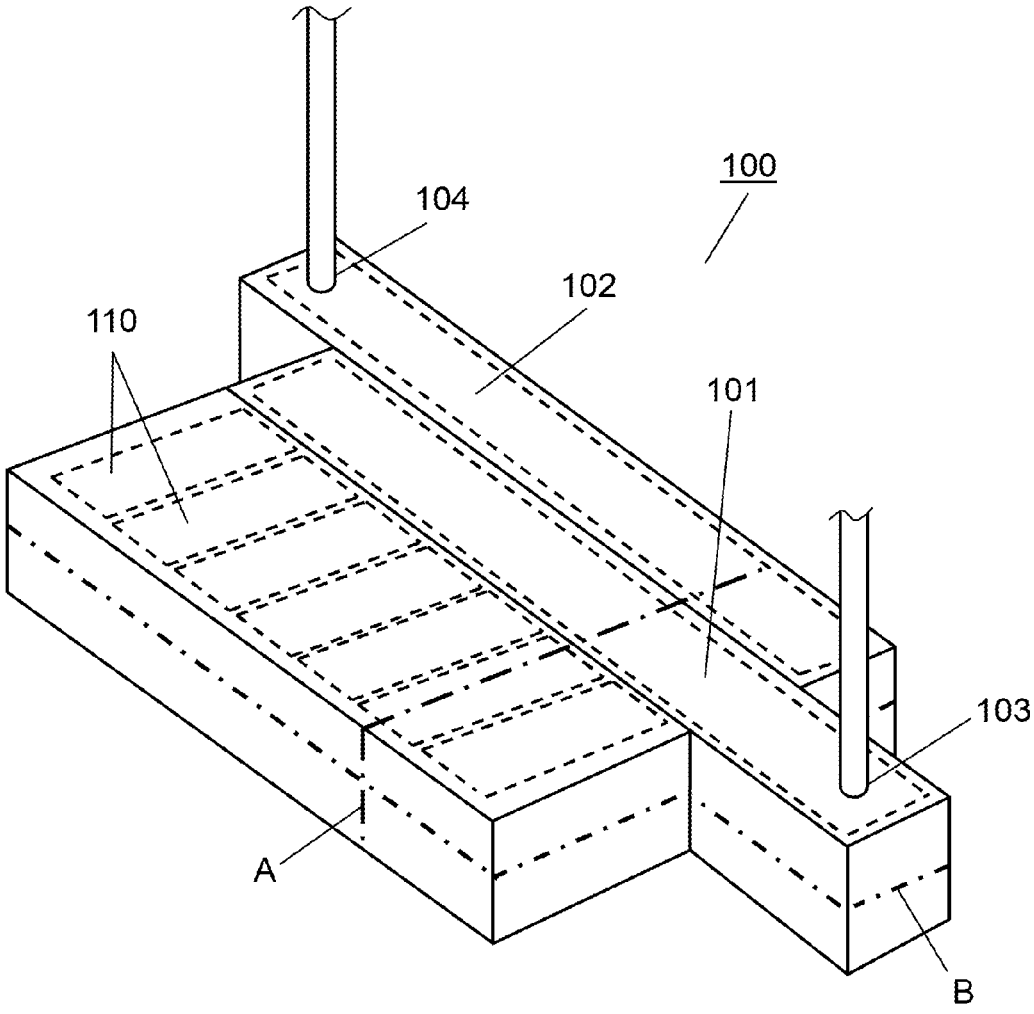
FIG. 1 is a perspective view of an ink-jet head according to an exemplary embodiment of the present invention.

An ink-jet apparatus according to embodiments of the present invention is a drop-on-demand piezoelectric ink-jet apparatus having a plurality of ink chambers.

A drop-on-demand ink-jet apparatus is a device capable of applying a required amount of ink when needed in response to an input signal, and especially, the drop-on-demand piezoelectric ink-jet apparatus can apply various kinds of ink under strict control. In addition, an ink-jet apparatus according to the present invention assumes an ink circulation type of ink-jet apparatus in which ink is circulated in an ink chamber.

The ink-jet apparatus according to the present invention includes an ink supply flow path, an ink discharge flow path, a plurality of ink chambers (or ink flow path), and a plurality of piezoelectric elements. The ink chambers are arranged in parallel, and the piezoelectric element is arranged in each ink chamber. Thus, the piezoelectric elements are arranged so as to be opposed to a flow path located upstream of a turn part formed in the ink flow path, and a flow path located downstream of the turn part, so that the ink-jet apparatus according to the embodiments of the present invention can surely eject high-viscosity ink, prevent the ink from being dried in the vicinity of a nozzle, and be miniaturized as a whole.

1. Basic Configuration of Ink-Jet Apparatus:

Hereinafter, components of the ink-jet apparatus will be described.

The ink supply flow path has an ink inlet to which the ink is supplied from outside, and has ink to be supplied to an ink chamber. While supplied amount of the ink to be supplied to the ink supply flow path is not limited in particular, it may be several ml/min or more. The ink supplied to the ink supply flow path through the ink inlet is distributed to the plurality of ink chambers.

The ink discharge flow path has an ink outlet to discharge the ink to outside, and has the ink discharged from the ink chambers.

The ink chamber is a space to hold the ink to be discharged from a nozzle. In the ink-jet apparatus according to the embodiments of the present invention, the ink chamber is formed between the piezoelectric element to be described below and the turn part provided in the ink flow path to connect the ink supply flow path and the ink discharge flow path. The preferable maximum number of the ink chambers connected to the ink supply flow path and the ink discharge flow path is 1024 in general.

Thus, the ink chamber and the ink supply flow path are connected through an ink supply hole. In addition, the ink chamber and the ink discharge flow path are connected through an ink discharge hole. Therefore, the ink flows from the ink supply hole to the ink discharge hole through the ink chamber. Thus, the ink is continuously supplied into the ink chamber. Since the ink is continuously supplied into the ink chamber, the ink can be prevented from stagnating or being clogged and air is prevented from being mixed in the ink chamber. In addition, a flow rate of the ink in the ink chamber is preferably 10 to 100 ml/min.

The nozzle is provided in the ink flow path. The nozzle is provided to eject the ink to outside. More specifically, the ink in the ink chamber is ejected from an ejection hole to outside through the nozzle. While a diameter of the ejection hole is not limited in particular, it is about 10 to 100 μm or about 20 μm in many cases. A direction of the ink ejected from the nozzle is roughly perpendicular to a direction of the ink flowing in the vicinity of the nozzle in the ink chamber (refer to FIG. 2).

In addition, while the kind of the ink housed in the ink chamber is not limited in particular, it is appropriately determined depending on the kind of product that incorporates the ink jet apparatus. For example, when the product is an organic EL panel or a liquid crystal panel, the ink housed in the ink chamber includes a solution of a light-emitting material containing an organic light-emitting material, or high-viscosity ink of a liquid crystal material. As described above, since the ink-jet apparatus according to embodiments of the present invention implements a strong ejection force, even the high-viscosity ink can be appropriately applied.

Figure 4:
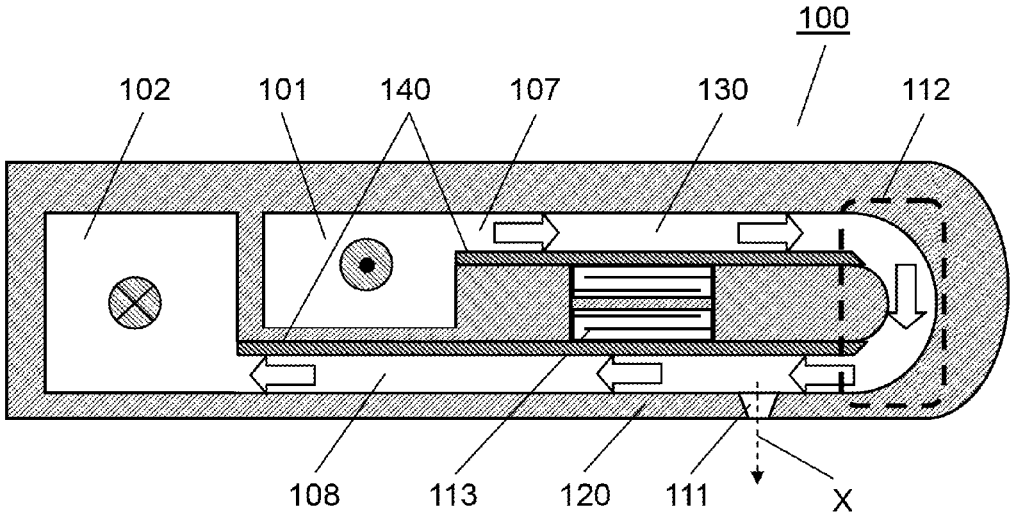
FIG. 4 is a cross-sectional view of an ink-jet apparatus according to a first variation of the first embodiment.

The piezoelectric element is an operating apparatus to convert a control signal such as a drive voltage, to an actual movement, and displace a wall surface (may have a vibration plate as shown in FIG. 4) of the ink flow path (ink chamber). When a voltage is applied to the piezoelectric element, a height of the piezoelectric element increases, and a pressure is applied to the ink in the ink chamber. Thus, the ink can be ejected from the nozzle. In addition, the piezoelectric elements according to embodiments of the present invention are arranged so as to be opposed to the flow path provided upstream of the turn part formed in the ink flow path, and the flow path provided downstream of the turn part. While the piezoelectric element according to embodiments of the present invention may be a thin-film type piezoelectric element or may be a laminated type piezoelectric element, it is more preferably the laminated type piezoelectric element.

This is because in the case of the thin-film type piezoelectric element, an output response to an input is fast, but its output is likely to become low. Therefore, in the case of the thin-film type piezoelectric element, the ejection is likely to vary depending on the ink pressure or viscosity in the ink chamber to be ejected. Therefore, an appropriate ejection cannot be implemented in some cases depending on the kind of ink. Meanwhile, in the case of the laminated type piezoelectric element, an output response to an input is slow, but its output can easily become high, so that it is hardly affected by the ink pressure in the ink chamber to be ejected, and stable ejection can be realized. In addition, a height of the laminated type piezoelectric element (length in a laminated direction) is 100 to 1000 μm in general.

In addition, the laminated type piezoelectric element is produced in such a manner that a drive body is made by laminating lead zirconium titanate (PZT) sheets and conductive films on a piezoelectric element plate, and the drive body is divided. The drive body may be divided by a dicing machine having a rotation blade incorporated therein.

2. Other Components

The ink-jet apparatus according to embodiments of the present invention has other members of the well-known ink-jet apparatus other than the above main components. For example, the ink-jet apparatus has a moving stage on which an object of ink application is set and moved.

In addition, since the ink-jet apparatus according to embodiments of the present invention circulates the ink, it has an ink circulation device (not shown). The ink circulation device circulates the ink by supplying driving pressure to the ink. The driving pressure may be applied to the ink with a pump, but it is preferable to use a regulator to apply the pressure with compressed air. By using the regulator, the driving pressure can be uniform, and a circulation speed of the ink can be stable. It is preferable that the ink of the ink-jet apparatus is continuously circulated during the operation in the ink-jet apparatus according to embodiments of the present invention.

Hereinafter, while embodiments of the present invention will be described with reference to the drawings, the present invention is not limited to the following embodiments.

First Embodiment

FIG. 1 is a perspective view of ink-jet apparatus 100 according to an embodiment of the present invention. As shown in FIG. 1, ink-jet apparatus 100 has ink supply flow path 101, ink discharge flow path 102, and ink chambers 110. In addition, ink supply flow path 101 has ink inlet 103. Ink discharge flow path 102 has ink outlet 104. In addition, ink-jet apparatus 100 shown in FIG. 1 is shared with a variation (perspective view) which will be described below.

Figure 2:
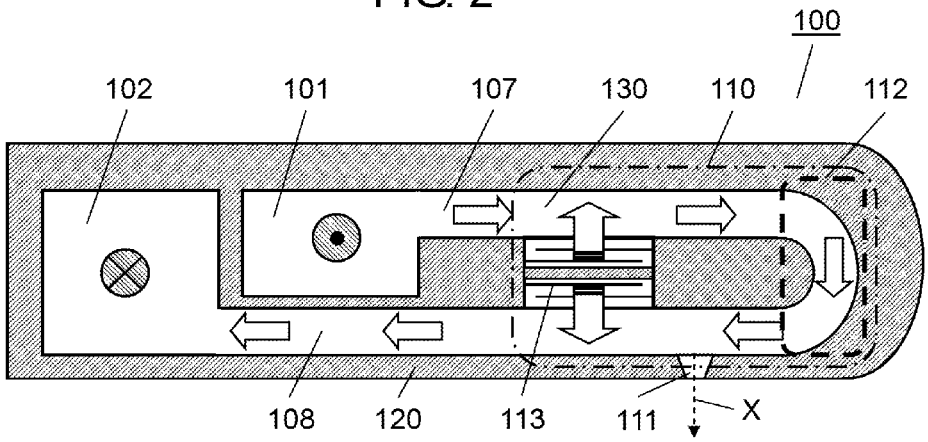
FIG. 2 is a cross-sectional view of an ink-jet head according to a first embodiment.
Figure 3:
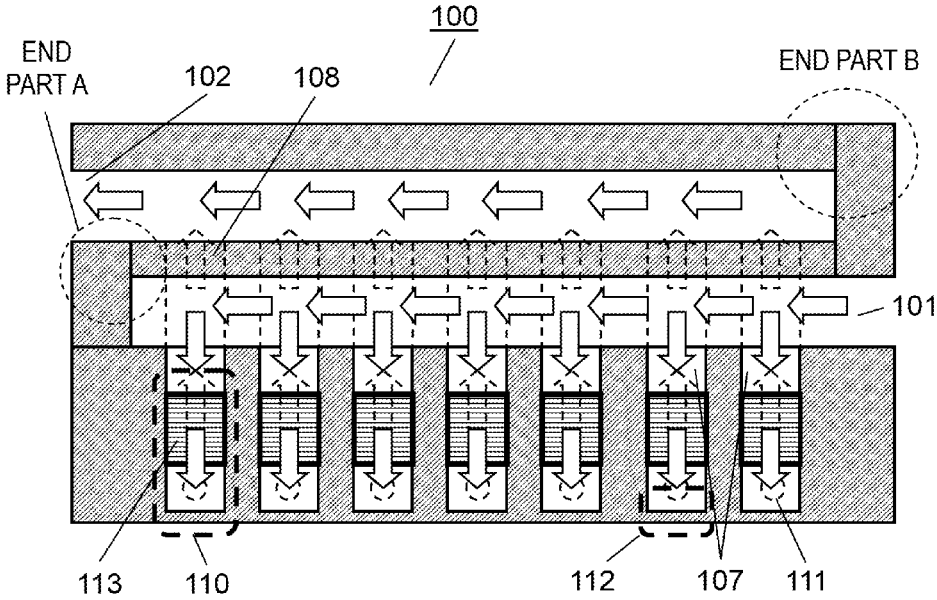
FIG. 3 is a top view of the ink-jet head according to the first embodiment.

FIG. 2 is a cross-sectional view taken along line A of ink-jet apparatus 100 shown in FIG. 1. FIG. 3 is a cross-sectional view (top view) taken along line B in ink-jet apparatus 100 shown in FIG. 1.

As shown in FIGS. 2 and 3, ink chamber 110 has nozzle 111 formed in nozzle plate 120 to eject the ink to outside. As shown in FIG. 2, nozzle 111 is preferably formed in a space formed between piezoelectric element 113 and turn part 112 in ink flow path 130, but it may be formed just under piezoelectric element 113 or in ink flow path 130 located downstream of a position of piezoelectric element 113. For example, when nozzle 111 is arranged just under piezoelectric element 113, responsiveness of ink ejection can be improved. In addition, even when nozzle 111 is arranged in ink flow path 130 located downstream of the position of piezoelectric element 113, nothing is wrong in particular as long as force generated when piezoelectric element 113 is driven is transmitted to nozzle 111.

In addition, ink chamber 110 is connected to ink supply flow path 101 through ink supply hole 107, and connected to ink discharge flow path 102 through ink discharge hole 108.

As shown in FIGS. 2 and 3, the ink flows in ink supply flow path 101 (in a forward direction perpendicular to a sheet surface in FIG. 2), and reaches ink chamber 110 through ink supply hole 107. Then, the ink reaches turn part 112 of ink flow path 130 through one surface of piezoelectric element 113. When piezoelectric element 113 is driven, a part of the ink is ejected from nozzle 111 to outside and the rest of ink flows in ink discharge flow path 102 (in a backward direction perpendicular to the sheet surface in FIG. 2) through the other surface of piezoelectric element 113 and ink discharge hole 108.

Piezoelectric element 113 is fixed to a base (having no reference) of the ink-jet apparatus. More specifically, as shown in FIG. 2, the surface on the side opposite to ink supply flow path 130 in piezoelectric element 113 is coupled to the base of the ink-jet apparatus. In addition, arrows shown in FIGS. 2 and 3 show ink flowing directions, which is the same in the following variation.

In addition, an ink-jet apparatus 100 as shown in FIG. 4 may be provided as a variation (1) of the first embodiment. That is, ink-jet apparatus 100 of the first variation includes vibration plate 140 provided so as to be opposed to at least piezoelectric element 113 in ink supply flow path 130 and vibration plate 140 is displaced by the drive of piezoelectric element 113. Thus, the aspect of applying a pressure to the ink in the ink flow path through vibration plate 140 can enhance reliability of the ink-jet apparatus as compared with that of the first embodiment shown in FIG. 2. More specifically, since piezoelectric element 113 is directly in contact with the ink in the embodiment shown in FIG. 2, the surface of piezoelectric element 113 gets rough due to ink drying, so that desired responsiveness could not be attained, or dust (generated when a material formed by the ink drying falls off) could be mixed in the ink. Meanwhile, since piezoelectric element 113 is not directly in contact with the ink in ink-jet apparatus 100 of the first variation, the reliability of the ink-jet apparatus is improved.

Figure 5:
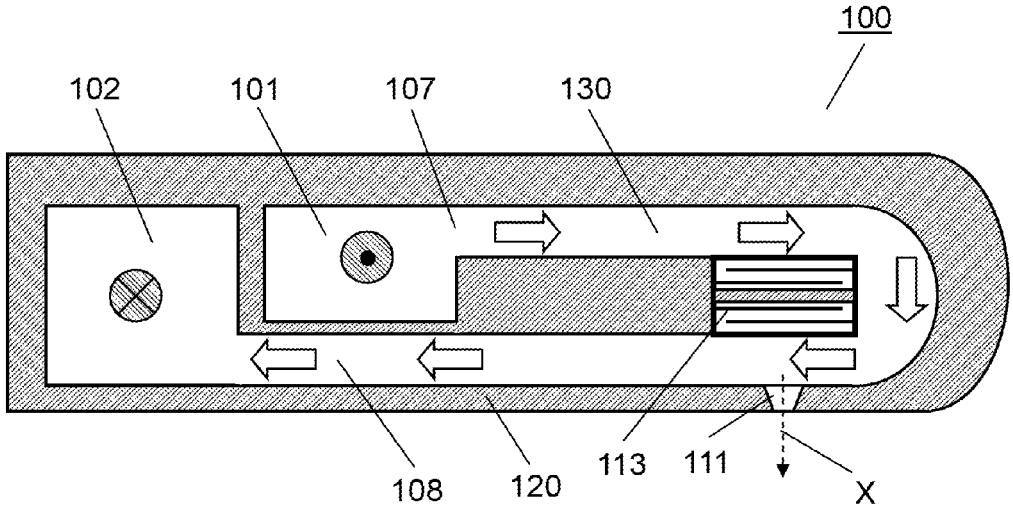
FIG. 5 is a cross-sectional view of an ink-jet apparatus according to a second variation of the first embodiment.

In addition, an ink-jet apparatus 100 as shown in FIG. 5 may be provided as a variation (2) of the first embodiment. That is, in ink-jet apparatus 100 of the second variation, piezoelectric element 113 is arranged such that one end thereof is opposed to turn part 112 of ink flow path 130. Thus, piezoelectric element 113 can be maximally close to turn part 112 of ink flow path 130, so that when piezoelectric element 113 is driven, the ink can be compressed to a narrow section (region) of the ink flow path. As a result, force (energy) to eject the ink from nozzle 111 can be increased.

Next, an operation of ink-jet apparatus 100 in this embodiment will be described with reference to FIGS. 6A to 6C.

Figure 6A:
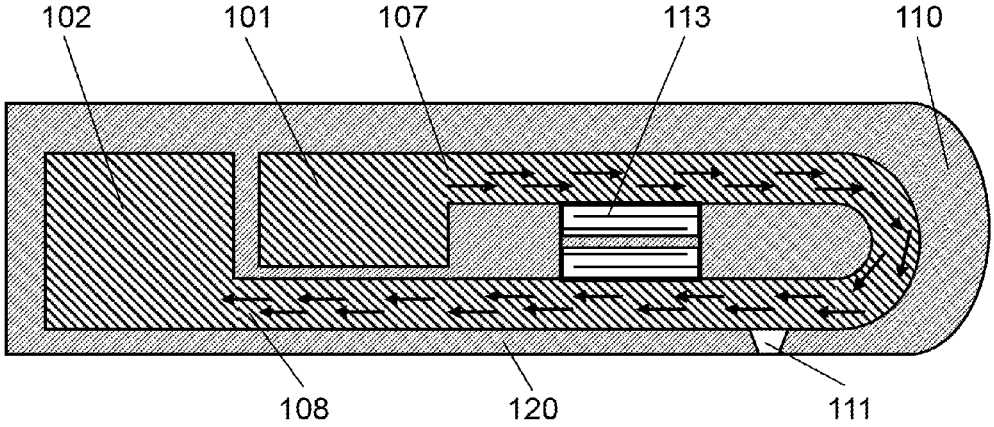
FIGS. 6A to 6C are views showing operations of the ink-jet apparatus according to exemplary embodiments of the present invention (relationship between drive of a piezoelectric element and ink flow)

As shown in FIG. 6A, in a case where the ink is not ejected from nozzle 111 in ink-jet apparatus 100, that is, piezoelectric element 113 is not driven, the ink flows from ink supply flow path 101 to ink flow path 130, and reaches ink discharge flow path 102. Arrows shown in FIGS. 6A to 6C show flowing directions and intensity of the ink. Thus, when the ink is to be ejected from nozzle 111, piezoelectric element 113 is driven in a desired cycle. FIG. 6B shows a state in which a drive voltage is applied to piezoelectric element 113, and one and the other surfaces of piezoelectric element 113 extend toward ink flow path 130.

Figure 6B:
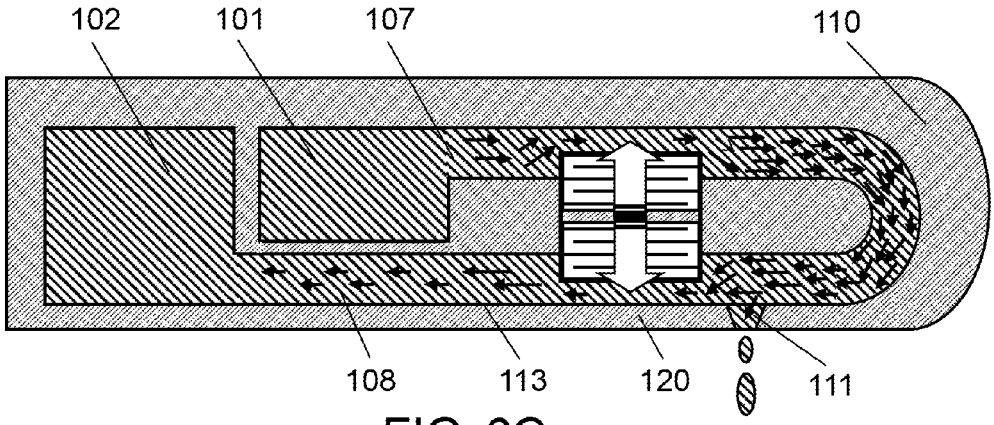
Figure 6C:
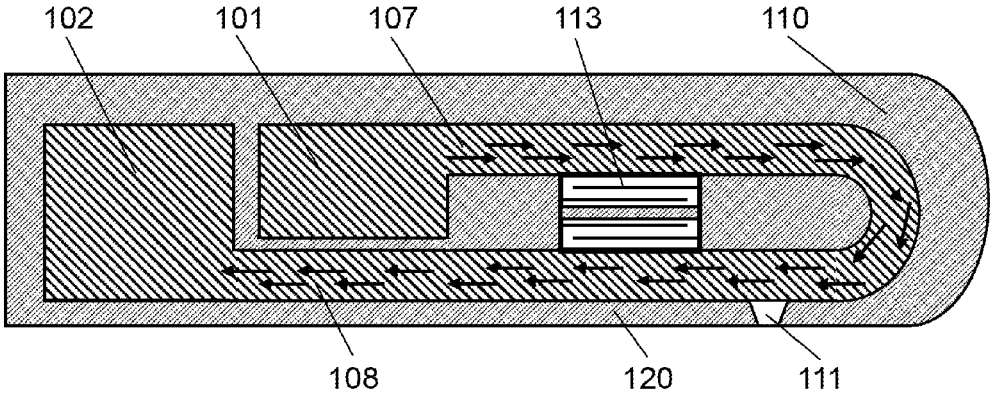

Then, the ink is temporarily compressed to a space (region) (referred to as an ink reservoir) formed between piezoelectric element 113 and turn part 112 in ink flow path 130, in response to a driving cycle of piezoelectric element 113 as shown in FIG. 6B. That is, as shown in FIG. 6B, the ink is compressed (collected) in the ink reservoir, so that the ink can be energetically ejected from nozzle 111. Thus, after piezoelectric element 113 returns to the original position, as shown in FIG. 6C, the ink flows in the ink flow path, so that ink-jet apparatus 100 can smoothly circulate the ink again.

Figure 7:
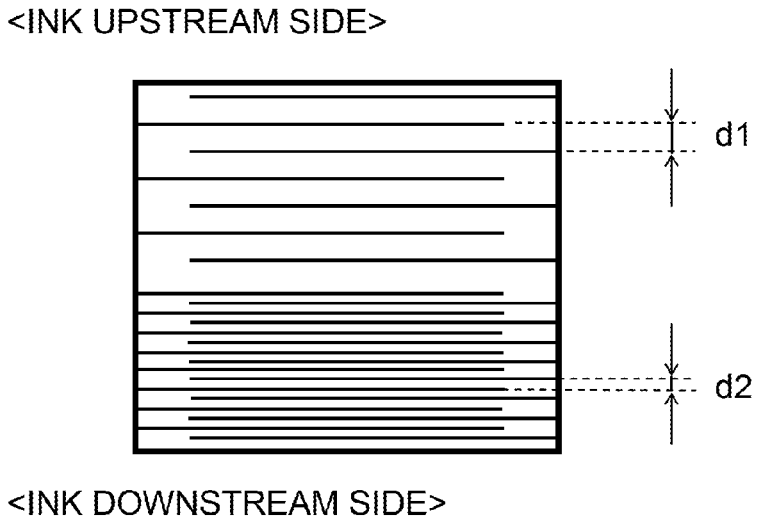
FIG. 7 is a view showing a structure of a piezoelectric element according to an exemplary embodiment of the present invention.

At this time, it is desirable to collect the ink in the ink reservoir effectively. More specifically, the ink can be effectively collected in the ink reservoir in the ink flow path flowing between ink supply path 101 and ink discharge path 102 by delaying response speed of the other surface (arranged downstream of the ink flow path) of piezoelectric element 113 with respect to the one surface (arranged upstream of the ink flow) of piezoelectric element 113. As a specific way to realize the above, piezoelectric element 113 may have a structure as shown in FIG. 7. That is, capacitance C [F] of a capacitor in piezoelectric element 113 can be defined by a formula 0 wherein S [$m^2$] represents a surface area of electrodes composing piezoelectric element 113, d [m] represents a distance between the electrodes, and ∈0 represents a proportionality constant (vacuum dielectric constant).

$$C=\in 0\cdot(S/d) \quad \text{(Formula 0)}$$

Here, since ∈0 and S are constant, the response speed of the other surface (arranged downstream of the ink flow path) of piezoelectric element 113 can be delayed (decreased) as compared with the one surface (arranged upstream of the ink flow path) of piezoelectric element 113 by setting an interelectrode distance d1 (gap) on the side provided upstream of ink flow path 130 larger than interelectrode distance d2 on the side provided downstream of ink flow path 130. The reason for this will be described below.

Since the response speed can be relatively differentiated between the one surface and the other surface of piezoelectric element 113 in this configuration of piezoelectric element 113, the ink can be effectively collected in the ink reservoir of the ink flow path.

Hereinafter, a description will be made of a relationship between electrostatic capacity and responsiveness of the piezoelectric element. An electromechanical coupling coefficient of the piezoelectric element can be expressed by a formula 1 wherein $K_{31}$ represents an electromechanical coupling coefficient (this is constant when a material is the same), $s_{11}$ represents a compliance of the piezoelectric element, and $\in_{33}$ represents a dielectric constant of the piezoelectric element.

$$K_{31}^2 = \frac{d_{31}^2}{s_{11}^E \varepsilon_{33}^T} \quad \text{(Formula 1)}$$

That is, the electromechanical coupling coefficient can be expressed by a formula 2.

$$K_{31} \propto \frac{d_{31}}{\sqrt{\varepsilon}} \quad \text{(Formula 2)}$$

That is, since the electromechanical coupling coefficient is constant, the dielectric constant increases as the piezoelectric constant d increases.

For example, the electrostatic capacity of the piezoelectric element can be calculated by a formula 3.

$$c = \varepsilon_0 \varepsilon \frac{S}{t} \quad \text{(Formula 3)}$$

The responsiveness of the piezoelectric element will be discussed based on the above relationship. Consideration is given to the responsiveness when a DC voltage E (V) is applied to a series circuit including resistance R (Ω) and capacitor C (F). It is assumed that a current flowing in the circuit is i (t) (A), and an electric charge stored in the capacitor is q (t) (coulomb) at a time t when a moment of the voltage application is a time 0. At this time, a circuit equation is as follows.

$$E = Ri(t) + \frac{q(t)}{C} \quad \text{(Formula 4)}$$

Here, the current means an electron flow, that is, a time-variable amount of the electric charge as follows.

$$i(t) = \frac{dq(t)}{dt}$$

Thus, the above formula can be rewritten as a differential equation relating to the electric charge q (t) as follows.

$$R\frac{dq(t)}{dt} + \frac{q(t)}{C} = E \quad \text{(Formula 5)}$$

Thus, the electric charge q (t) can be expressed by an exponential function relating to the time t as follows.

$$q(t) = CE\left(1 - \exp\left(-\frac{t}{RC}\right)\right) \quad \text{(Formula 6)}$$

When a voltage of the capacitor is $e_c$ (t), a relational expression is obtained from q (t)=C$e_c$ (t) as follows.

$$e_c(t) = E\left(1 - \exp\left(-\frac{t}{RC}\right)\right) \quad \text{(Formula 7)}$$

Here, $\tau$ is defined as a time constant of the RC circuit. As $\tau$ increases, it takes more time for $e_c$ (t) to reach its maximum value E. The time constant is proportional to a resistance value and the electrostatic capacity of the circuit. As the resistance of the circuit increases, and as the electric charge induced by the capacitor increases, it takes more time to charge the capacitor.

Based on the above relationship, the time constant $\tau$ in the piezoelectric element is calculated as follows.

$$\tau = RC \quad \text{(Formula 8)}$$

That is, as the gap of the laminated piezoelectric element increases, the electrostatic capacity decreases, and thus the time constant decreases. Consequently, the gap is to be increased to improve the responsiveness, and decreasing the laminated number of the piezoelectric elements is more advantageous to the responsiveness.

Figure 8:
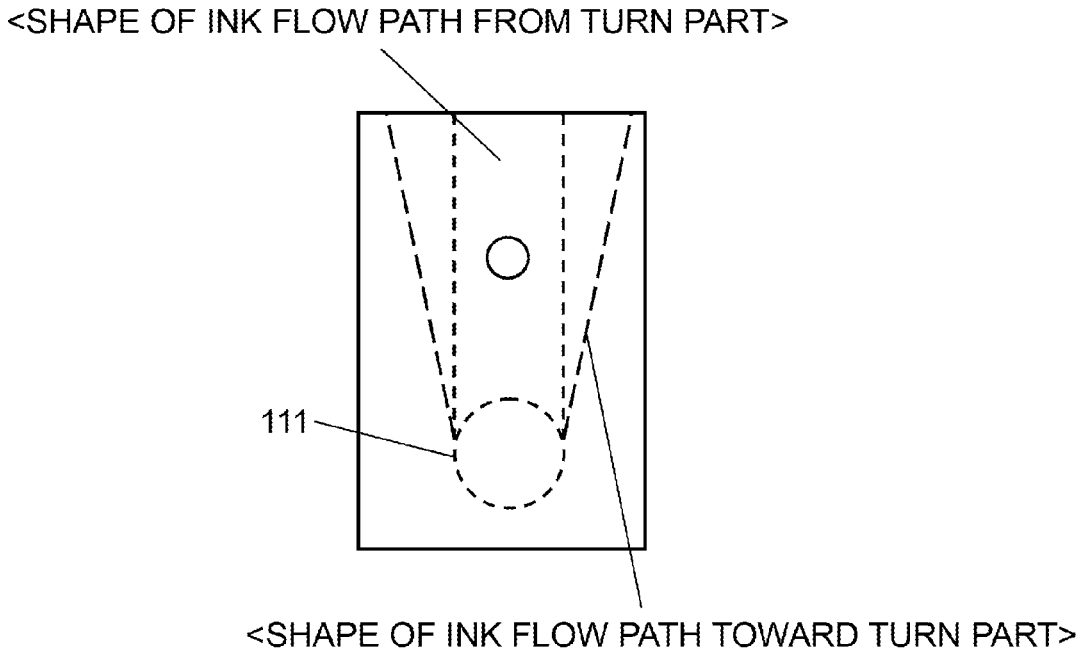
FIG. 8 is a cross-sectional view of an ink-jet apparatus according to a third variation of the first embodiment.

As a variation of this embodiment, a third variation may be provided as shown in FIG. 8. That is, ink-jet apparatus 100 of the third variation is configured such that a cross sectional area of the ink flow path gradually becomes smaller from ink supply flow path 101 to a turn part. Due to this configuration, ink can be effectively collected in the ink reservoir, and the ink also can be pressed strongly, so that ejection force of the ink can be more enhanced in nozzle 111. In addition, FIG. 8 is a cross-sectional view of a part of the ink-jet apparatus shown in FIG. 2 obliquely viewed from nozzle 111.

Figure 9A:
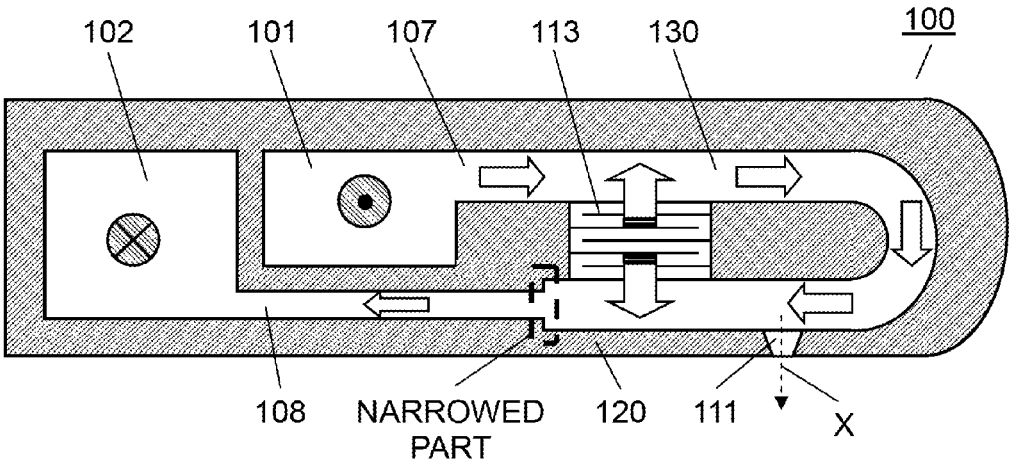
FIGS. 9A and 9B are cross-sectional views of ink-jet apparatuses according to a fourth variation of the first embodiment.
Figure 9B:
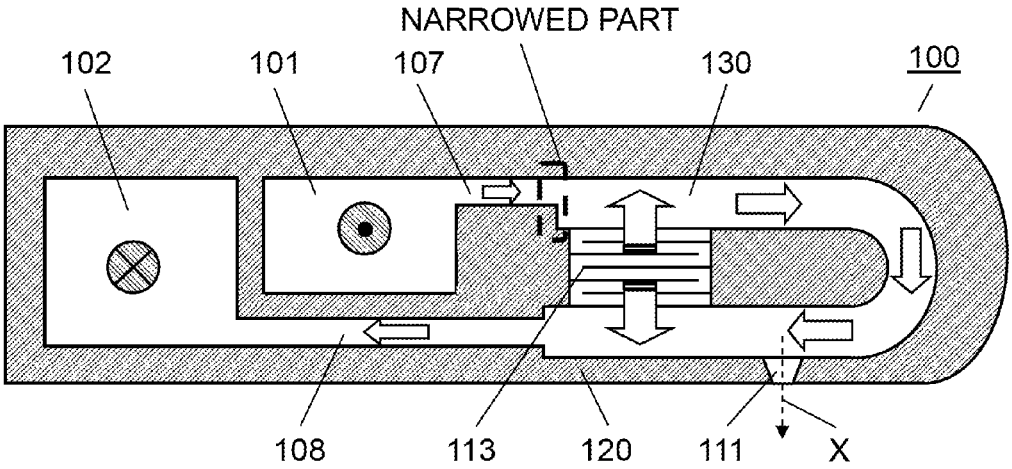

In addition, as a variation of this embodiment, a fourth variation may be provided as shown in FIG. 9A. That is, ink-jet apparatus 100 of the fourth variation is configured to have a section in which a cross-sectional area of the flow path changes (more specifically, the cross-sectional area of the flow path becomes smaller), in a part of ink flow path 130 from nozzle 111 toward ink discharge flow path 102. Due to this configuration, resistance of the flow path provided downstream of nozzle 11 can be increased in ink flow path 130, and the ejection force of the ink from nozzle 111 can be more enhanced. In addition, ink-jet apparatus 100 may be provided as shown in FIG. 9B. That is, a section in which a cross-sectional area of the flow path changes, that is, the cross-sectional area of the flow path increases, is provided in a part of ink flow path 130 from ink supply flow path 101 toward piezoelectric element 113.

In this case, when piezoelectric element 113 is driven, force applied from one surface opposed to upstream of ink flow path 130 in piezoelectric element 113 toward the ink is prevented from reversely flowing to ink supply flow path 101. That is, the force driven by piezoelectric element 113 can be effectively transmitted to turn part 112, so that the ink can be strongly ejected from nozzle 111.

Figure 10A:
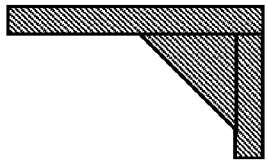
FIGS. 10A to 10C are views showing structures of end parts of ink supply flow paths and ink discharge flow paths according to this embodiment.
Figure 10B:
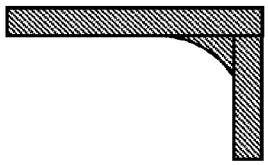
Figure 10C:
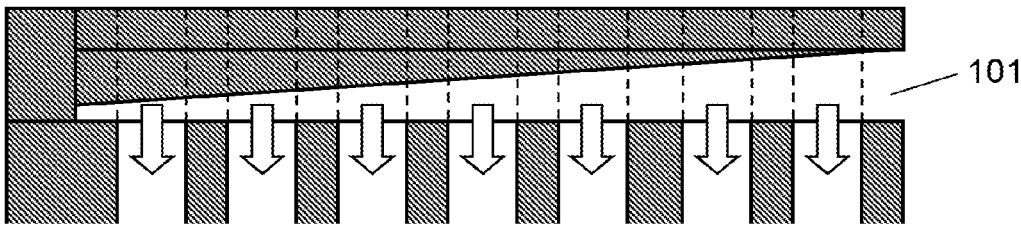

In addition, according to this embodiment, it is preferable that a most downstream part (end part A in FIG. 3) of ink supply flow path 101 is tapered as shown in FIG. 10A or curved as shown in FIG. 10B. This is because the ink could stagnate in the corner part of ink supply flow path 101 while the ink flows from ink supply flow path 101 to ink chamber 101. In addition, as shown in FIG. 10C, ink supply flow path 101 itself may be gradually narrowed in a downstream direction.

While it is not shown, with the same idea, it is preferable that a most upstream part (end part B in FIG. 3) of ink discharge flow path 102 is tapered, or curved, or ink discharge flow path 102 itself is gradually narrowed in an upstream direction, with a view to improving ink flow. These ideas are shared with the above first embodiment (including the variations).

3. Effects

As described above, the embodiments of the present invention provide the following effects. That is, the embodiments of the present invention implement the combination of (1) the strong ink ejection to surely eject the high-viscosity ink, and (2) the ink circulation to prevent the ink from being dried in the vicinity of the nozzle, and (3) the miniaturization of the device as a whole. Hereinafter, the effects will be described.

First, as for the first effect, the ink-jet apparatus according to the embodiments of the present invention is configured such that the piezoelectric elements are arranged upstream and downstream of the turn part formed in the ink flow path, so that the ink can be effectively collected in the ink flow path. Thus, the voltage is applied to the piezoelectric element in this state, and the ink is pressed by the displacement of the piezoelectric element, so that the ink can be energetically ejected from the nozzle. In addition, as described above, the ink-jet apparatus according to the embodiments of the present invention has the turn part formed in the ink flow path, so that the ink flowing in the ink flow path can be stirred in the turn part. Therefore, the ink can be prevented from stagnating in the ink flow path, so that the ink can be surely ejected from the nozzle.

Next, as for the second effect, the ink-jet apparatus according to the embodiments of the present invention has the ink flow path connected to the ink supply flow path and the ink discharge flow path, so that the ink can be circulated. In addition, as described in the above, the ink-jet apparatus according to the embodiments of the present invention has the turn part formed in the ink flow path, so that the ink can be effectively stirred and an ink concentration can be uniform. Therefore, the ink can be prevented from stagnating in the ink flow path, especially in the vicinity of the nozzle, and the ink is prevented from drying in the vicinity of the nozzle. As a result, the reliability of the ink-jet apparatus can be improved.

Figure 11:
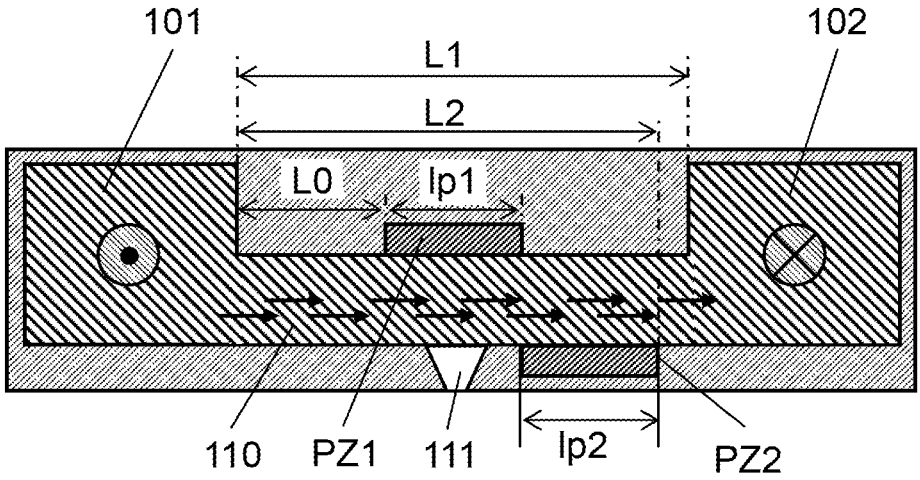
FIG. 11 is a cross-sectional view of an ink-jet apparatus to be compared.

Finally, as for the third effect, a description will be made with reference to an ink-jet apparatus having piezoelectric elements arranged upstream and downstream of a nozzle as shown in FIG. 11.

In the ink-jet apparatus shown in FIG. 11, ink flows from ink supply flow path 101 (in a forward direction perpendicular to a sheet surface in FIG. 11) to ink discharge flow path 102 (in a backward direction perpendicular to the sheet surface in FIG. 11) through ink chamber 110. In this case, piezoelectric element PZ1 (width: $lp_1$) is arranged upstream of nozzle 111, and piezoelectric element PZ2 (width: $lp_2$) is arranged downstream of nozzle 111. Thus, distance L2 from ink supply flow path 101 to an end of piezoelectric element PZ2 on the side of ink discharge flow path 102 is equal to $L0+lp_1+lp_2$ wherein L0 represents a distance from ink supply flow path 101 to an end of piezoelectric element PZ1 on the side of ink supply flow path 101, $lp_1$ represents the width of piezoelectric element PZ1 and $lp_2$ represents the width of piezoelectric element PZ2.

Here, piezoelectric element PZ1 and piezoelectric element PZ2 may be partially overlapped with each other, so that it is considered that distance L2 is smaller than $L0+lp_1+lp_2$ in design, but piezoelectric element PZ1 and piezoelectric element PZ2 cannot be completely overlapped with each other in the ink-jet apparatus in FIG. 11. Therefore, the ink-jet apparatus as shown in FIG. 11 is inevitably larger in width as compared with the ink-jet apparatus according to the embodiments of the present invention. Thus, the ink-jet apparatus according to the embodiments of the present invention can be miniaturized.

In addition, as an additional effect, since the ink-jet apparatus according to the embodiments of the present invention has the turn part formed in the ink flow path, piezoelectric element 113 arranged upstream of the nozzle, and piezoelectric element 113 arranged downstream of the nozzle are not likely to interfere with each other. For example, in the case of the ink-jet apparatus as shown in FIG. 11, when piezoelectric element PZ2 arranged downstream of the nozzle is driven, a wave of the ink generated by piezoelectric element PZ2 is transmitted upstream of the piezoelectric element PZ2. In this case, piezoelectric element PZ1 arranged upstream of the nozzle is affected, and the ink could be prevented from being ejected from the nozzle.

Meanwhile, the ink-jet apparatus according to the embodiments of the present invention is configured to have the turn part in the ink flow path, so that the piezoelectric elements arranged upstream and downstream of the nozzle are not likely to interfere to each other, and the ink can be preferably ejected.

The ink-jet apparatus according to the embodiments of the present invention can eject ink strongly, and circulate the ink, so that high-viscosity ink can be stably applied to an object. Therefore, the ink-jet apparatus according to the embodiments of the present invention is preferably used as an ink-jet apparatus to apply an organic light-emitting material in producing an organic EL display panel, and the like.

What is claimed is:

1. An ink-jet apparatus comprising:

an ink supply flow path supplied with ink from an ink inlet;

an ink discharge flow path configured to discharge the ink to an ink outlet; and an ink flow path configured to connect the ink supply flow path to the ink discharge flow path, having at least one turn and having a nozzle configured to eject the ink, wherein piezoelectric elements are provided in the ink flow path, the piezoelectric elements are arranged to be opposed to the ink flow path and are provided upstream of a turn part in the ink flow path and downstream of the turn part in the ink flow path, and a flow path cross-sectional area gradually becomes smaller in the ink flow path from the ink supply flow path toward the turn part.

2. The ink-jet apparatus according to claim 1, wherein the nozzle is provided between the piezoelectric element and the turn part in the ink flow path.

3. The ink-jet apparatus according to claim 1, wherein an end part of the piezoelectric element is arranged to be opposed to the turn part in the ink flow path.

4. The ink-jet apparatus according to claim 1, wherein a width of electrodes of the piezoelectric element arranged upstream of the turn part is larger than a width of electrodes of the piezoelectric element arranged downstream of the turn part.

5. The ink-jet apparatus according to claim 1, wherein a vibration plate is arranged between the piezoelectric element and the ink flow path.

6. The ink-jet apparatus according to claim 1, wherein a flow path cross-sectional area becomes smaller at a part provided in the ink flow path from the nozzle toward the ink discharge flow path.

7. The ink-jet apparatus according to claim 6, wherein a flow path cross-sectional area becomes larger at a part provided in the ink flow path from the ink supply flow path toward the turn part.

8. The ink-jet apparatus according to claim 1, wherein a most downstream part of the ink supply flow path is tapered or curved.

9. The ink-jet apparatus according to claim 1, wherein the ink supply flow path is configured to gradually narrow in a downstream direction.

10. The ink-jet apparatus according to claim 1, wherein a most upstream part of the ink discharge flow path is tapered or curved.

11. The ink-jet apparatus according to claim 1, wherein the ink discharge flow path is configured to gradually narrow in an upstream direction.

* * * * *